United States Patent [19]

Forrest et al.

[11] Patent Number: 4,807,708

[45] Date of Patent: Feb. 28, 1989

[54] DIRECTIONAL DRILLING OF A DRILL STRING

[75] Inventors: John Forrest; Roger Catherall, both of Aberdeen; William Stewart, New Pitsligo; Randall J. Pounds, Aberdeen, all of United Kingdom

[73] Assignee: Drilex UK Limited and Eastman Christensen Company, United Kingdom

[21] Appl. No.: 79,780

[22] PCT Filed: Nov. 28, 1986

[86] PCT No.: PCT/GB86/00727

§ 371 Date: Oct. 1, 1987

§ 102(e) Date: Oct. 1, 1987

[87] PCT Pub. No.: WO87/03329

PCT Pub. Date: Jun. 4, 1987

[30] Foreign Application Priority Data

Dec. 2, 1985 [GB] United Kingdom ..... 8529651

[51] Int. Cl.[4] ..... E21B 7/08

[52] U.S. Cl. ..... 175/45; 175/61; 175/76; 175/325

[58] Field of Search ..... 175/73, 76, 45, 325, 175/61, 92, 107, 26

[56] References Cited

U.S. PATENT DOCUMENTS

| | | | |
|---|---|---|---|
| 3,224,513 | 12/1965 | Weeden, Jr. | 175/45 |
| 3,544,957 | 12/1970 | Smetanin et al. | 175/45 X |
| 3,561,549 | 2/1971 | Garrison et al. | 175/323 X |
| 4,185,704 | 1/1980 | Nixon, Jr. | 175/76 |
| 4,317,493 | 3/1982 | Thompson | 175/45 X |
| 4,319,649 | 3/1982 | Jeter | 175/73 |

FOREIGN PATENT DOCUMENTS

| | | |
|---|---|---|
| 0085444 | 8/1983 | European Pat. Off. . |
| 3417743 | 3/1985 | Fed. Rep. of Germany . |
| 2544375 | 10/1984 | France . |
| 2121453 | 12/1983 | United Kingdom . |

*Primary Examiner*—Stephen J. Novosad

*Attorney, Agent, or Firm*—Bell, Seltzer, Park & Gibson

[57] ABSTRACT

A method of controlling the direction of a drill bit (3) at the downhole end of a drill string (2) drilling from a surface comprises providing two steerable stabilizers (4, 5) at the downhole end of the drill string (2) at locations spaced apart in the drilling direction and adjusting the orientation of the stabilizers to create reactive forces from the bore hole (6) to deflect the course of the bit (3) in a desired direction. The stabilizers (4, 5) are suitably arranged eccentrically and circumferentially offset by 180°±60°. In normal drilling the drill string (2) is rotated such that stabilizers (4, 5) engage the bore hole (6) to support a downhole motor (1) against tilting. When off course drilling is sensed the stabilizers are rotated to a position and stopped from rotation such that drilling forces generate reaction forces to cause a desired change of direction.

4 Claims, 4 Drawing Sheets

DIRECTIONAL DRILLING OF A DRILL STRING

Figure 1:
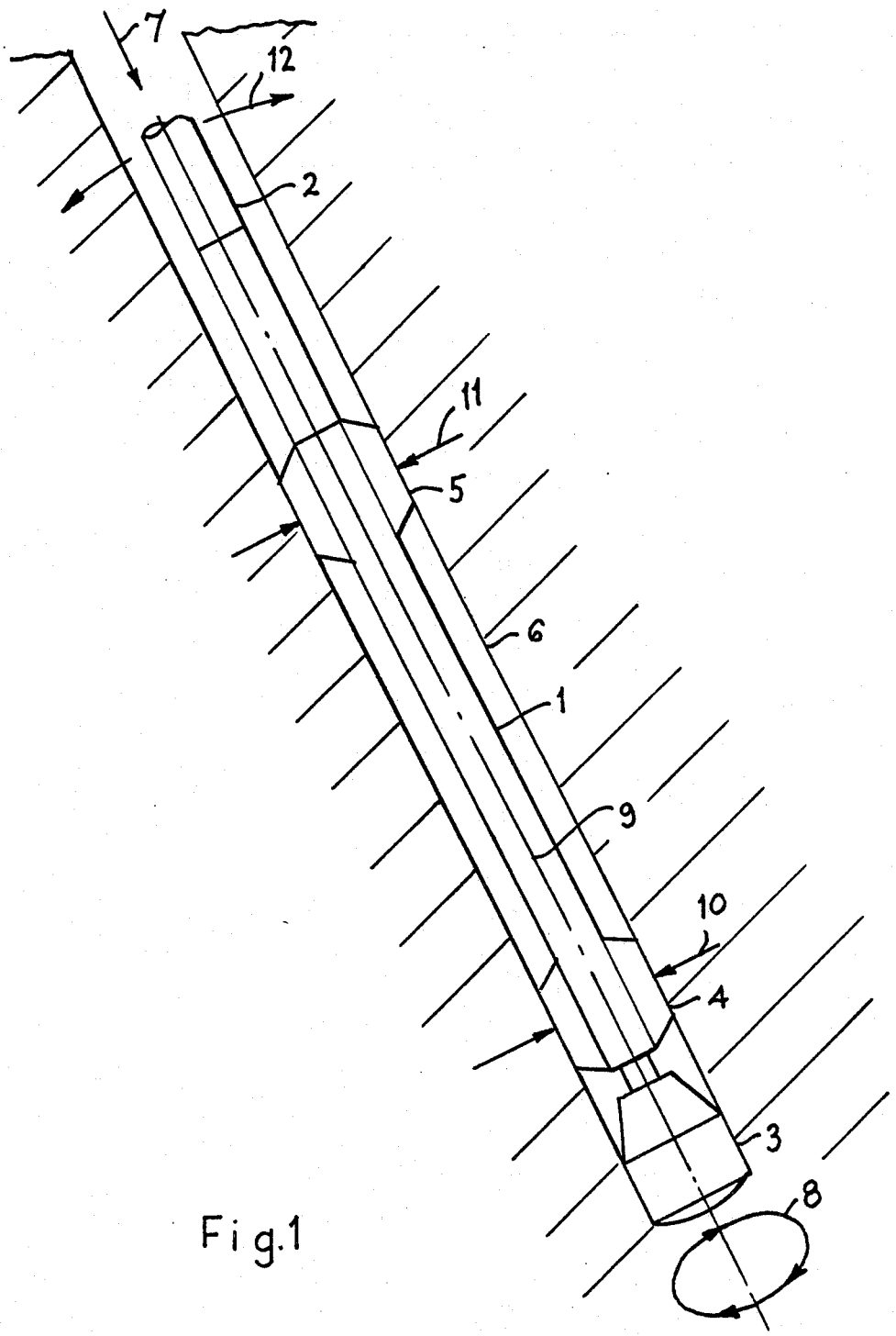

This invention rleates to means for and a method of controlling the direction of a drill bit at the downhole end of a drill string.

When drilling with a drill bit at the downhole end of a drill string it is important to control the direction of the bore hole to reach a desired objective. Forces which act on the drill bit are gravity, torque developed by the bit, the end load applied to the bit, and the bending moment from the drill assembly. These forces together with the type of strata being drilled and the inclination of the strata to the bore hole create a complex interactive system of forces which make it impossible to drill a hole on a constant course without having means for generating forces to change the direction of the drill bit. Withdrawal of the drill string to provide such means is time consuming.

It is known to provide sleeve type stabilisers along a drill string, and in particular at the downhole end of the string to support the drill string and the drill bit generally centrally of the bore hole.

It is an object to provide downhole means for generating forces controllable from the surface for changing the direction of travel of a drill bit of a drill string.

According to one aspect of the invention a method of controlling the direction of a drill bit at the downhole end of a drill string drilling from a surface comprises providing two steerable stabilisers at the downhole end of the drill string at locations spaced longitudinally in the drilling direction and adjusting the orientation of the stabilisers from the surface to create reactive forces from the bore hole to deflect the course of the bit in a desired direction.

Suitably the drill string rotation is stopped when adjusting the stabilisers, and the adjustment is made in response to downhole measurements as to direction of the drill bit. Means for effecting the measurements are suitably mounted above a downhole motor or turbine powering the drill bit.

According to another aspect the invention includes means for controlling the direction of a drill bit at the downhole end of a drill string which comprise a lower drill string drill sub-assembly extending axially in the drilling direction and provided with a pair of bore hole stabilisers spaced apart longitudinally in the drilling direction and steerably mounted in relation to the sub-assembly by means adapted to be remotely controlled whereby adjustment of the stabiliser can alter the inclination of the sub-assembly in relation to the bore hole axis to alter the drilling direction.

Suitably the sub-assembly is a downhole motor or turbine and the steerable stabilisers are mounted on the motor casing, one at the bottom adjacent the drill bit and the other near the top of the motor or at the bottom of the superjacent drill string assembly.

A third stabiliser fixedly mounted on the motor casing and concentric with the drilling axis may be provided approximately midway between the adjustable stabilisers.

The steerable stabilisers are suitably sleeve type stabilisers eccentrically arranged in relation to each other. Suitably the steerable stabilisers are offset from the axis of the downhole motor and drill bit assembly in opposite directions, and in particular by 180°∓60°.

In normal drilling the downhole motor is rotated by the drill string such that the steerable sleeve type stabilisers are rotated and engage the bore hole to support the motor against lateral or tilting movement under reaction of the drilling forces, and the adjustable stabilisers are free in the bore hole and the assembly will drill at a near constant course and direction according to the strata being drilled.

The bore hole path is determined by continuous survey, typical survey instruments giving hole direction, inclination and tool face. The tool face measurement determines the orientation of a reference line on the circumference of the drill string, usually known as a scribe line, which is aligned with a known reference line on the steerable stabilisers.

When the survey instrument indicates to an operator on the surface the orientation of the scribe line, he also knows the orientation of the steerable stabilisers in the bore hole. Thus when the instrument indicates an off-course bore hole inclination, the drill string may be rotated through an angle to steer the steerable stabilisers to such circumferential locations of the bore hole that with the drill string and steerable stabilisers stationary drill reaction forces caused by further drilling will exert a direction changing couple to urge the drill in the desired direction. Drilling may then continue with the drill string stationary until the survey instrument indicates that the desired direction has been attained. At this time the drill string is set into rotation such that the steerable stabilisers are rotated free in the hole to provide a balanced stabilising action.

In a typical application, the motor with its stabilisers would be oriented in a certain direction as drilled holding the stabilisers at orientation constant by slight adjustment on the drill string. Once the set interval has been drilled, typically 15′ and 90′ (4.6 and 27.5 m) the string would then be oriented so that the survey instrument would be in line with the section of hole which has been drilled in the orientated mode. A survey would then be taken, which in comparison with previous surveys, would show the operator how much effect the stabilisers had had in changing hole inclination or direction. With this information, the operator can either decide to continue in the orientated mode or change to achieve the objective. If the well is tracking in the desired direction and inclination, the operator would choose to rotate the drill string and continue the present well path. Continuous surveys would be taken to monitor the drill path and the above procedure repeated as necessary.

Figure 2:
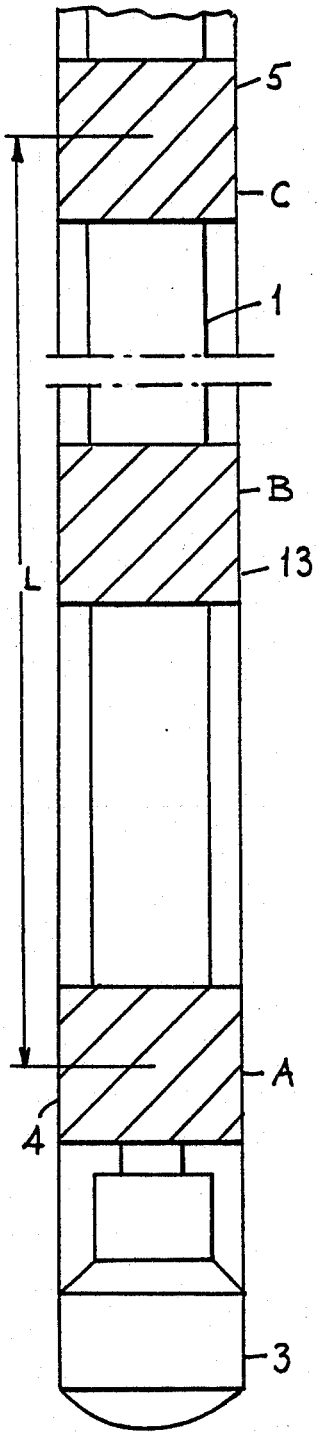
Figure 3C:
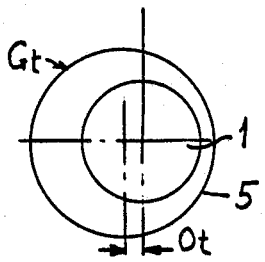
Figure 3B:
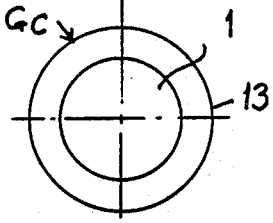
Figure 3A:
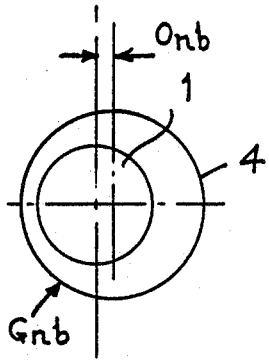
Figure 4:
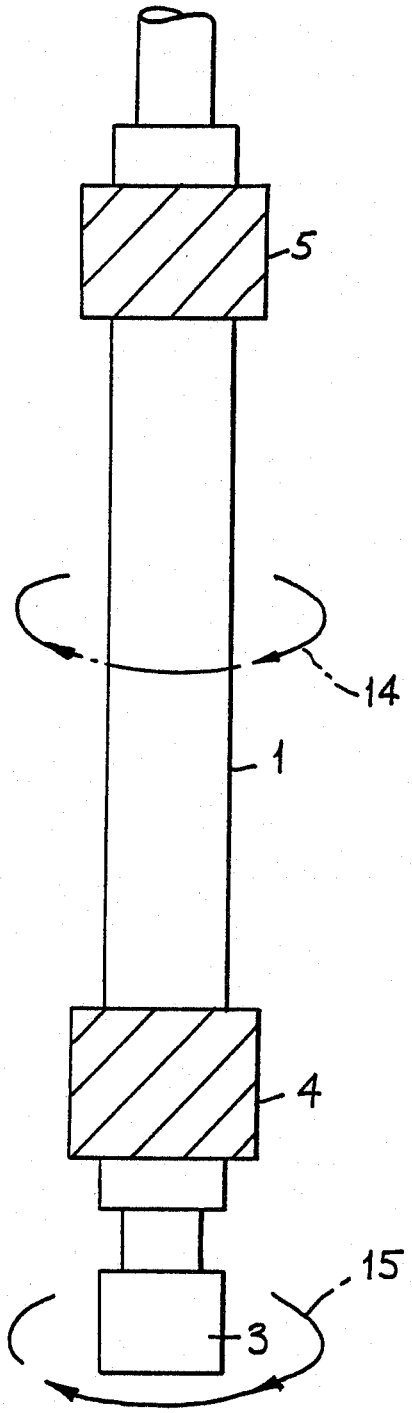
Figures 5, 6:
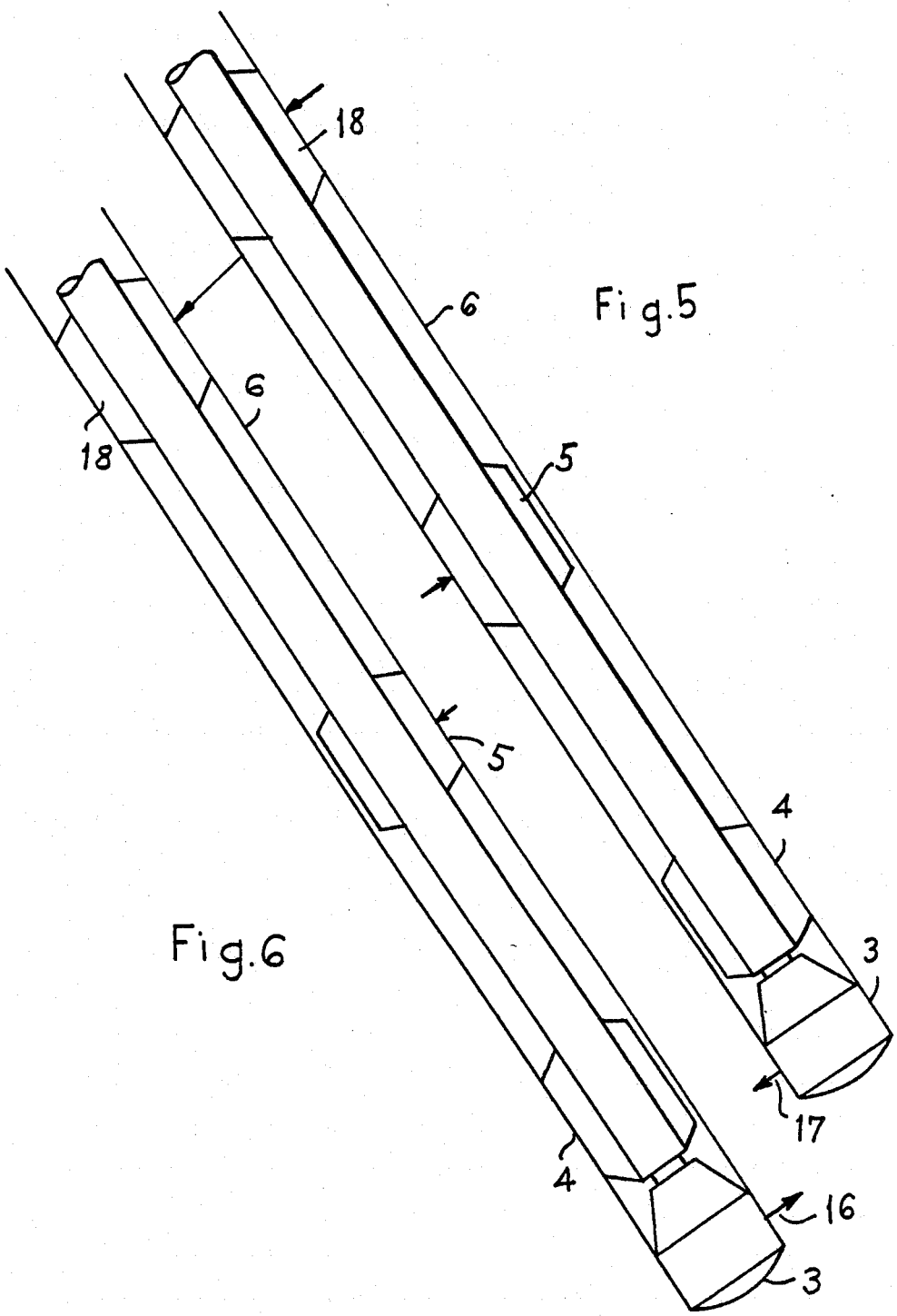

The invention will now be described, by way of example, with reference to the accompanying partly diagrammatic drawings, in which:

FIG. 1 is a downhole view of a drilling assembly showing the forces acting on the assembly, FIG. 2 is a downhole view of a drilling assembly according to the invention in side elevation, FIGS. 3A, 3B and 3C are sectional plan views of the assembly of FIG. 2 at stabilisers A, B and C, FIG. 4 is a downhole elevation of a drilling assembly illustrating rotation of both motor casing and drill bit, and FIGS. 5 and 6 are downhole elevations of a drill assembly according to the invention showing the steerable stabilisers in opposite orientations.

The drill assembly of FIG. 1 comprises a downhole motor 1 at the lower end of a drill string 2 and driving a drill bit 3. Sleeve stabilisers 4, 5 are mounted at the lower and upper ends of the motor 1 and serve to locate the motor 1 in the bore hole 6. During operation of the drill 3 the assembly is subject to a down thrust 7 from the drill string 2, a torque 8 at the drill 3 about the axis 9 of the assembly, a near bottom reaction 10 on the lower stabiliser 4 and a top reaction 11 on the upper stabiliser 5, the reactions 10,11 being transversely of the axis 9, and an upper bending moment 12 at the upper end of the assembly from the drill collar assembly and about the drill as fulcrum. These forces will be dynamically balanced.

According to one embodiment of the invention as shown in FIGS. 2 and 3A, B and C, the drill motor 1 is provided at A with a near bottom sleeve type stabiliser 4 which as seen in FIG. 3A is eccentrically arranged with respect to the motor 1 with an axial offset of $O_{nb}$ and having a gauge $G_{nb}$. The upper sleeve type stabiliser 5 at C is, as seen at FIG. 3C, eccentrically arranged with respect to the motor 1 with an axial offset $O_t$ 180° opposed to the offset $O_{nb}$, and having a gauge $G_t$. The stabilisers 4 and 5 are axially spaced by a distance L in the drilling direction. An intermediate sleeve type stabiliser 13 at B is positioned substantially midway between the upper and lower stabilisers, 4,5 and as seen in FIG. 3B is coaxially arranged with respect to the motor 1 and has a gauge $G_c$ slightly below the gauge of the drill bit 3.

A typical assembly would be the following: Bit, motor with offset stabilisers, drill collar, survey tool, stabiliser, drill collars, jars, HWDP, drill pipe.

Typical sizes and offsets (though not limited to these) would be the following:

For 17½" hole (44.4 cm):

Top Stabiliser $G_T$ 17½ to 16½ (44.4 to 41.9 cm) Example 17" (43.2 cm)

$O_T$ 0 to 1½" (0 to 3.81 cm) Example ½" (1.27 cm)

Bottom Stabiliser $G_{nb}$ 17½ to 16½ (44.4 to 41.9 cm) Example 17 7/16" (44.4 cm)

$O_{nb}$ 0 to 1" (0–2.54 cm) Example 3/16 (0.48 cm)

For 12¼" (31.12 cm):

$G_T$ 12½–11½ (31.12–29.21 cm) Example 12⅛" (30.80 cm)

$O_T$ 0–1" (0–2.54 cm) Example ⅜" (0.95 cm)

$G_{nb}$ 12¼–12" (31.12–30.48 cm) Example 12 3/16" (30.96 cm)

$O_{nb}$ 0–1" (0–2.54 cm) Example ⅛" (0.32 cm)

For 8½" (21.59 cm)

$G_T$ 8½–7½– (21.59–19.05 cm) Example 8¼" (20.84 cm)

$O_T$ 0–¾" (0–1.91 cm) Example ¼" (0.64 cm)

$G_{nb}$ 8½–7¾" (21.59–19.69 cm) Example 8 7/16" (20.43 cm)

$O_{nb}$ 0–½" (0–1.27 cm) Example ⅛" (0.32 cm)

The distance L should be between 10 and 40 feet (3–12.2 m) with the near bit stabiliser 4 attached to the motor 1 at its extreme lower end. One of the stabilisers 4,5 may be permanently fixed whilst the other can be a clamp-on type so that the relative position of the offsets $O_{nb}$ and $O_t$ may be adjusted between 180° opposed plus or minus 60°. The amount of offset of the stabilisers may be between 1/16" and 1 inch (1.59 mm–2.54 cm) depending on the bore hole diameter, and the middle stabiliser gauge may be reduced by up to ½ inch (1.27 cm) from the bit gauge depending on the gauge diameter of the steerable upper and lower stabilisers.

Steerable stabilisers will be selected from a range of offset and gauge sizes in relation to the nature of strata to be drilled to obtain appropriate rates of angle build and azimuth correction, depending on the inclination of the bore hole and the rate of change of direction required.

When a correction is necessary, the drill string rotation is stopped and the tool is set from the surface, based on downhole measurements, whereby the pair of steering stabilisers is orientated to create reactive forces to deflect the course of the bit in the desired direction.

As shown in FIG. 4, when the drill string is rotating the motor casing will also rotate as indicated at 14 and the drill will rotate as indicated at 15 at the sum of motor casing speed and motor speed; whereas with the drill string stationary the drill will rotate at the motor speed.

As shown in FIGS. 5 and 6 with the steerable stabilisers 4,5 located at opposite oientations, the stabilisers will be driven against opposite sides of the bore hole to exert a lateral thrust on the drill bit 3 to urge the drill to change direction as required as indicated by arrows 16,17. The drill string above the motor 1 and the steerable stabilisers 4,5 is suitably provided at intervals with coaxial sleeve type stabilisers 18 which according to usual practice will be slightly under gauge to provide for clearance in the bore hole 6.

We claim:

1. Apparatus for controlling the direction of a drill bit (3) at the downhole end of a drill string (2) characterised by a lower drill string drill sub-assembly (1) extending axially in the drilling direction and provided with a pair of bore hole stabilisers (4, 5) spaced apart longitudinally in the drilling direction (7), said stabilisers (4, 5) being eccentrically arranged with respect to the drilling axis in opposite manner and steerably mounted in relation to said lower drill string drill sub-assembly (1) by means adapted to be remotely controlled whereby adjustment of said stabilisers (4, 5) can alter the inclination of said sub-assembly (1) in relation to the bore hole (6) axis to alter the drilling direction (7), said sub-assembly (1) including a downhole motor in a casing, and wherein said stabilisers (4, 5) are mounted on said motor casing, one at the bottom adjacent said drill bit (3) and the other near the top of the motor (1), and a third stabiliser (13) being fixedly mounted on said motor casing and concentric with the drilling axis approximately midway between said stabilisers (4, 5).

2. Apparatus as claimed in claim 1 characterised in that said stabilisers (4, 5) are of the sleeve type and are eccentrically arranged in relation to each other.

3. Apparatus as claimed in claim 1 characterised in that said stabilisers (4, 5) are offset from the axis of said downhole motor and said drill bit (3) in opposite directions by 180°±60°.

4. A method of operating an apparatus as claimed in claim 1 to control the direction of said drill bit (3), said method comprising the steps of rotating said drill string (2) so that said stabilisers (4, 5) are rotated and engage the bore hole (6) to support said downhole motor against lateral or tilting movement under reaction of the drilling forces and so that said stabilisers (4, 5) guide the drill sub-assembly (1) at substantially a constant course and direction, according to the strata being drilled, surveying the path of the bore hole (6) to determine the hole direction, inclination and tool face, the tool face measurement determining the orientation of a scribe line on the circumference of said drill string (2) which is aligned with a known reference line on said stabilisers (4, 5) so that the survey instrument indicates to an operator on the surface when an off-course bore hole (6) inclination occurs, and adjusting the position of said stabilizers (4, 5) when such off-course boring occurs, to steer said stabilisers (4, 5) to the proper circumferential locations relative to the bore hole (6) that the drill reaction forces caused by further drilling will exert a changing direction to the drill (3) and direct the same in the desired direction.

* * * * *

UNITED STATES PATENT AND TRADEMARK OFFICE

CERTIFICATE OF CORRECTION

PATENT NO. : 4,807,708

DATED : February 28, 1989

INVENTOR(S) : John Forrest, et al

It is certified that error appears in the above-identified patent and that said Letters Patent is hereby corrected as shown below:

Column 1, line 4, "rleates" should be -- relates --.

Column 3, line 40, "12 1/2" should be -- 12 1/4 --.

Column 3, line 46, "8 1/2 - 7 1/2-" should be -- 8 1/2 - 7 1/2" --.

Column 4, line 13, "oientations" should be -- orientations --.

Signed and Sealed this

Twenty-fourth Day of October, 1989

*Attest:*

*Attesting Officer*

DONALD J. QUIGG

*Commissioner of Patents and Trademarks*